US006250565B1

(12) United States Patent
Ogie et al.

(10) Patent No.: US 6,250,565 B1
(45) Date of Patent: Jun. 26, 2001

(54) FLAMINGO SPRINKLER

(75) Inventors: Sam Ogie, Batavia; Kyle A. Houchens; David DuBois, both of East Aurora, all of NY (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 09/479,937

(22) Filed: Jan. 10, 2000

(51) Int. Cl.[7] ..... B05B 1/00

(52) U.S. Cl. ..... 239/211; 239/289; 239/229; 239/251; 239/273; 239/276; 239/279; 446/267; 446/275; 40/412; D23/215

(58) Field of Search ..... 239/211, 289, 239/229, 251, 273, 276, 279; 446/267, 275; 40/412, 417, 419; D23/215, 222; D21/606

(56) References Cited

U.S. PATENT DOCUMENTS

| | | | | |
|---|---|---|---|---|
| D. 73,327 | | 8/1927 | McArdle . | |
| D. 83,691 | | 3/1931 | Mayerhofer . | |
| D. 176,556 | | 1/1956 | Russell | D91/1 |
| D. 260,279 | | 8/1981 | Geller et al. | D23/9 |
| D. 268,279 | | 3/1983 | Geller et al. | D23/9 |
| D. 390,313 | * | 2/1998 | Smith | D23/215 |
| 1,767,911 | | 6/1930 | Berko et al. . | |
| 1,989,525 | | 1/1935 | Moore | 299/57 |
| 2,030,605 | | 2/1936 | Moore | 299/65 |
| 2,046,225 | | 6/1936 | Vickery | 299/67 |
| 2,087,175 | * | 7/1937 | Voight | 239/211 X |
| 2,241,092 | | 5/1941 | Jurgilanis | 299/57 |
| 2,631,060 | * | 3/1953 | Cook | 239/211 X |
| 2,634,545 | * | 4/1953 | Gertz | 46/41 |
| 4,235,378 | | 11/1980 | Melin et al. | 239/229 |
| 4,261,514 | | 4/1981 | Kennard et al. | 239/211 |
| 5,261,603 | | 11/1993 | Driska | 239/211 |
| 5,277,641 | | 1/1994 | Gable et al. | 446/46 |
| 5,338,044 | * | 8/1994 | Mazursky et al. | 446/320 X |
| 5,419,494 | | 5/1995 | Harwood | 239/211 |
| 5,505,380 | | 4/1996 | Jun | 239/211 |

* cited by examiner

*Primary Examiner*—Patrick Brinson
*Assistant Examiner*—Robin O. Evans
(74) *Attorney, Agent, or Firm*—Morgan Lewis & Bockius

(57) ABSTRACT

A toy sprinkler with the appearance of an amusing figure or creature with appendages that simulate movement of the appendages of the figure or creature. Liquid carrying conduits extending along appendages of the figure cause the appendages to move either in a planar path when liquid at low pressure passes through the conduits, or randomly when liquid at high pressure passes through the conduits.

27 Claims, 5 Drawing Sheets

FLAMINGO SPRINKLER

BACKGROUND OF THE INVENTION

This invention relates to a sprinkler, and in particular to a play sprinkler designed for children. The sprinkler has movable parts that change the direction of water discharged from the sprinkler, providing for an entertaining area for the child to play.

There are other sprinklers with movable parts that change the direction of the discharged water. Many of these sprinklers generally either create movement of appendages that are random due to connections allowing universal movement, create no motion of an appendage attached to a water tube, create rotating motion, or create movement through water sprays that directly impact a moveable body part. U.S. Pat. No. 2,030,605 to Moore discloses a lawn sprinkler with a relatively movable part that moves due to a supply of water to the sprinkler. The figure has an upper arm section and a lower arm section pivotally mounted thereto, and moveable relative to the body of the figure. The connections between the moveable sections are made of interchanged rings or eyes capable of universal movement such that when water flows through the hose, the arm sections randomly wiggle in an erratic manner. The universal joint movement between the sections and the rotation of the figure make it appear that the jointed arm sections move about erratically with respect to each other and with respect to movement of the figure.

U.S. Pat. No. 4,261,514 to Kennard discloses a similar lawn sprinkler of a human figure with an arm having sections that are pivotally mounted to and moveable relative to the body. The sections are attached together by means of ball and socket universal joints permitting random movement. Kennard also discloses the figure being rotatable in the vertical direction and the horizontal direction such that the figure pivots reciprocally right and left while rotating about a vertical axis due to the water flow engaging a turbine blade.

U.S. Pat. No. 4,235,378 to Melin discloses a water play toy with multiple flexible hollow tubes attached to an outlet section at the top of the toy. The water flow imparts random motion on the hollow tubes.

U.S. Pat. No. 5,505,380 to Jun; U.S. Pat. No. 5,419,494 to Harwood; and U.S. Pat. No. 2,241,092 to Jurgilanis disclose lawn sprinklers utilizing water pressure to drive a rotating appendage. Harwood uses either internal water flow or reaction forces from water jets to rotate a decorative element.

Another water sprayer configured in the form of an animal is shown in U.S. Pat. No. 5,261,603 to Driska. The water sprayer includes a stationary torso and legs and a movable tail, head, and ears. The tail and ears move when they are directly impacted by streams of water that are sprayed through various outlet nozzles. The ears flap about the head moving both backwards, forwards, inwardly and outwardly relative to the head as different parts of the ears are hit by the fluid jets. Because the head is also rotating, the point of impact of the fluid jets on the ears is constantly varying so that the flapping is essentially random. Another two spray jets impact the tail causing it to pivot from side to side relative to the torso.

SUMMARY OF THE INVENTION

The presently disclosed sprinkler is more entertaining for both children and adults than other sprinklers because of, among other reasons, the movement of the sprinkler. The sprinkler can be in the shape of an animal or other figure and it not only sprays water, but it utilizes the water spray to move the appendages of the animal figure in a similar way as the actual appendage of the animal would move. The appendages of the animal figure can also be made to move in a more random manner not necessarily representative of how the actual appendage of a real animal would move.

As described herein, an example of such a sprinkler is one shaped like a flamingo having wings and a support member that resembles the legs of a flamingo to which water under pressure is supplied. A tube exits the body of the figure and runs the length of each appendage. A nozzle is inserted into one end of each tube that provides a restriction to the flow of water from the tubes. The flow of water through the tubes and out of the nozzles causes each tube to move. The tubes are connected to the appendages and body of the figure so that water flow through the tubes at relatively low pressures results in movement of the appendages that is substantially planar. At relatively high pressures the movement of the appendage is substantially random.

Each appendage, a water supply conduit supporting the body, and the body are joined together in a substantially triangular configuration. The appendages and the tubes extending along the appendages are substantially flexible while the body and water supply conduit supporting the body are rigid. Each appendage is planar and detachably connected to the body such that it is flexible in a direction perpendicular to the plane of the appendage, but resists motion in a direction parallel to the plane of the appendage. A proximal portion of each appendage is hingedly connected to the body to allow reciprocating movement of the appendage in a direction substantially perpendicular to the plane of the appendage . The relative flexibility of the appendage allows greater freedom of movement of the distal portion of the appendage. The water tubes extending along the appendages are also relatively flexible. To prevent the tubes from twisting, each tube is connected to a corresponding appendage by a connector having greater rigidity than the appendage and having a major axis perpendicular to the major axis of the tube. Each connecter spans a substantial portion of the width of the appendage to which it is connected with the connector being placed on the appendage relatively near to the hinge created between the appendage and the body. The connectors serve to increase the resistance of the appendages to twisting out of the plane of movement of the appendages, and hold the water tubes in position along the underside of the appendages. The wider the connectors, the greater the restoring torque they apply to the appendages.

Although the structure of the sprinkler assembly tends to restrain motion of the appendages to a single plane, at higher water pressures the flow of water through the tubes attached to the appendages can generate sufficient forces to overcome the resistance to motion of the appendages outside of that primary plane. With high enough water pressures, movement of the appendage along with increased twisting of the tube, especially at the far end of the appendage, can approach a more random motion outside of the primary plane of motion.

BRIEF DESCRIPTION OF THE DRAWINGS

The accompanying drawings, which are incorporated in and constitute a part of this specification, illustrate one embodiment of the invention and together with the description, serve to explain the principles of the invention.

DESCRIPTION OF THE PREFERRED EMBODIMENT

Reference will now be made in detail to the present preferred embodiment of the invention, which is illustrated in the accompanying drawings. Wherever possible, the same reference numbers will be used throughout the drawings to refer to the same or like parts.

Figure 1:
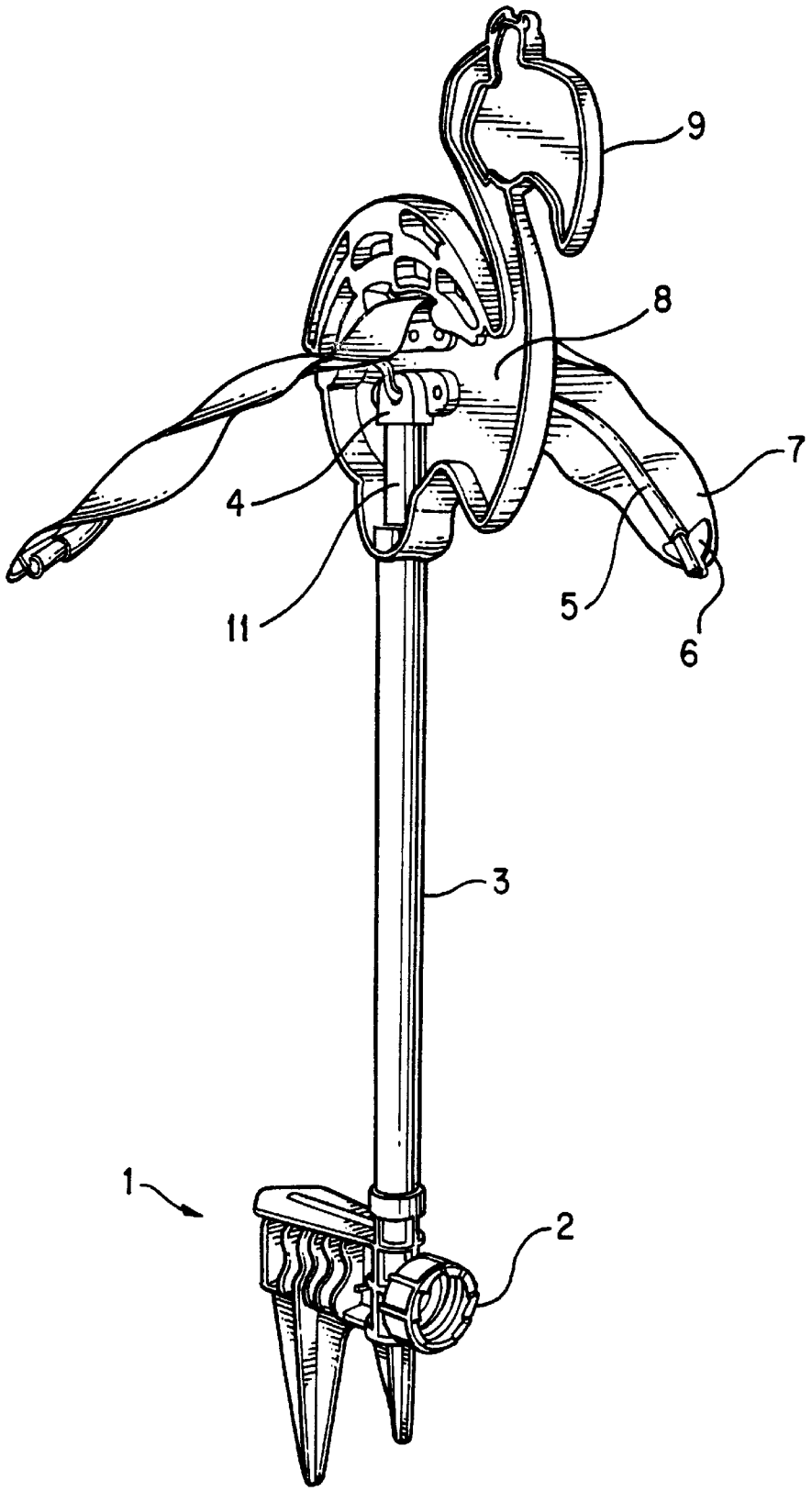
FIG. 1 is a perspective view of a sprinkler according to the invention.
Figure 2:
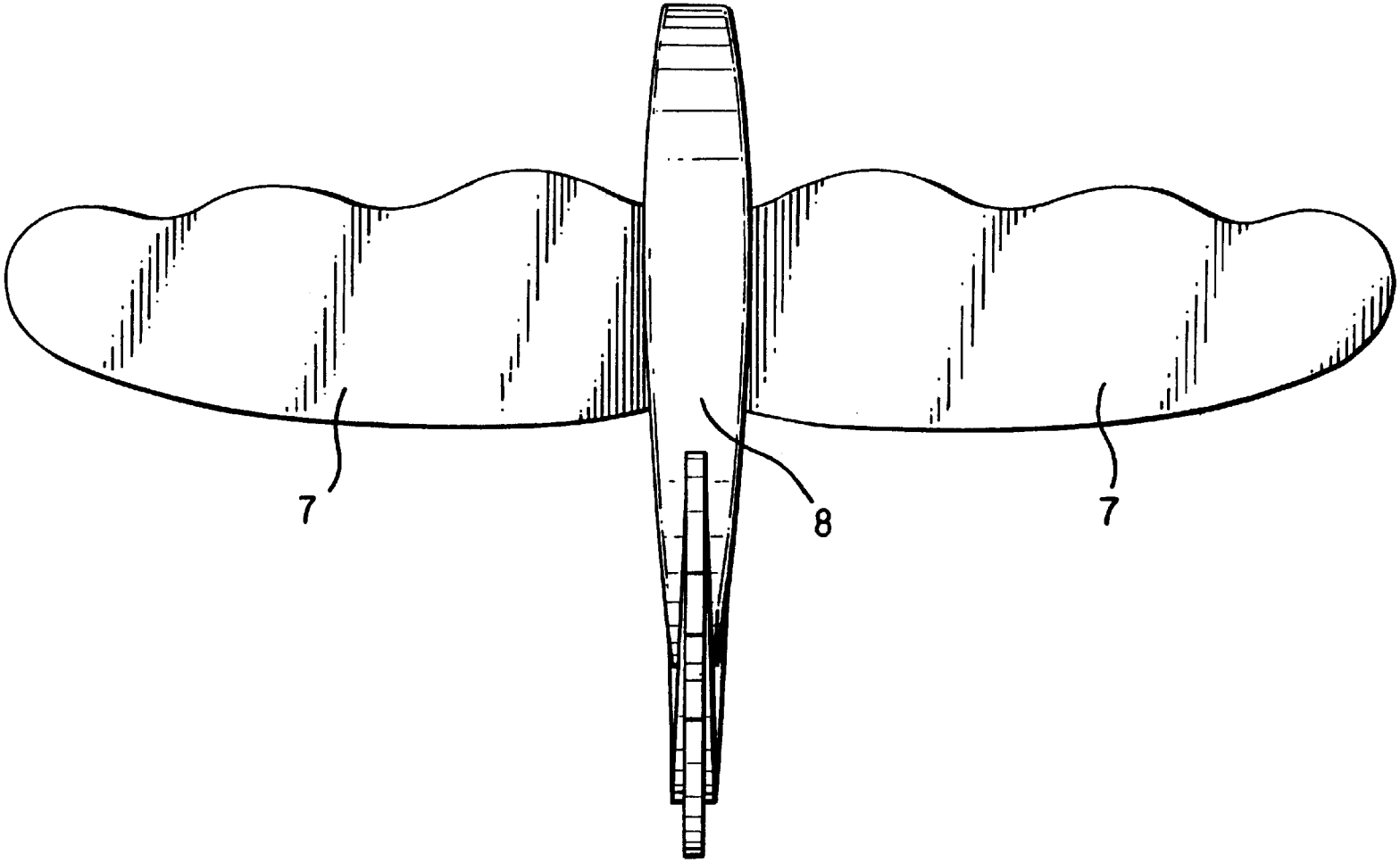
FIG. 2 is a top plan view of the sprinkler.

A perspective of the sprinkler 9 is shown in FIG. 1. The sprinkler is in the form of a flamingo having a body 8, two appendages shaped like wings 7, and a support appendage resembling a flamingo's leg 3 that acts as a water conduit. A ground engaging member designed to resemble a foot 1 of the flamingo is attached at the base of the leg 3, and is provided with a coupler 2 that is adaptable to a water hose. The wings 7, body 8, leg 3 and foot 1 can be formed as separate pieces and mechanically coupled together using conventional joining techniques such as threaded connections, ultrasonic welding etc. Alternatively, two or more of the components such as the wings 7, leg 3, body 8, and foot 1 can be coupled together by integrally molding the components as one piece from elastomeric materials such as polyethylene.

The top end of the leg 3 terminates in a reservoir 11 that is positioned along a portion of the body 8. Water supplied from a garden hose or other fixed supply connected to the coupler 2 is directed up leg 3 and into reservoir 11 formed at the end of the leg 3. The reservoir is provided with one or more exits for directing the water through fittings such as T-couplings 4, best seen in FIG. 4. The T-couplings 4 provide connections to conduits, which in this embodiment are flexible (but taut) water tubes 5 that can be made of polyvinylchloride tubing, or other plastic or flexible materials. The tubes 5 extend along wings 7 and terminate at nozzles 6.

Figures 3, 3A:
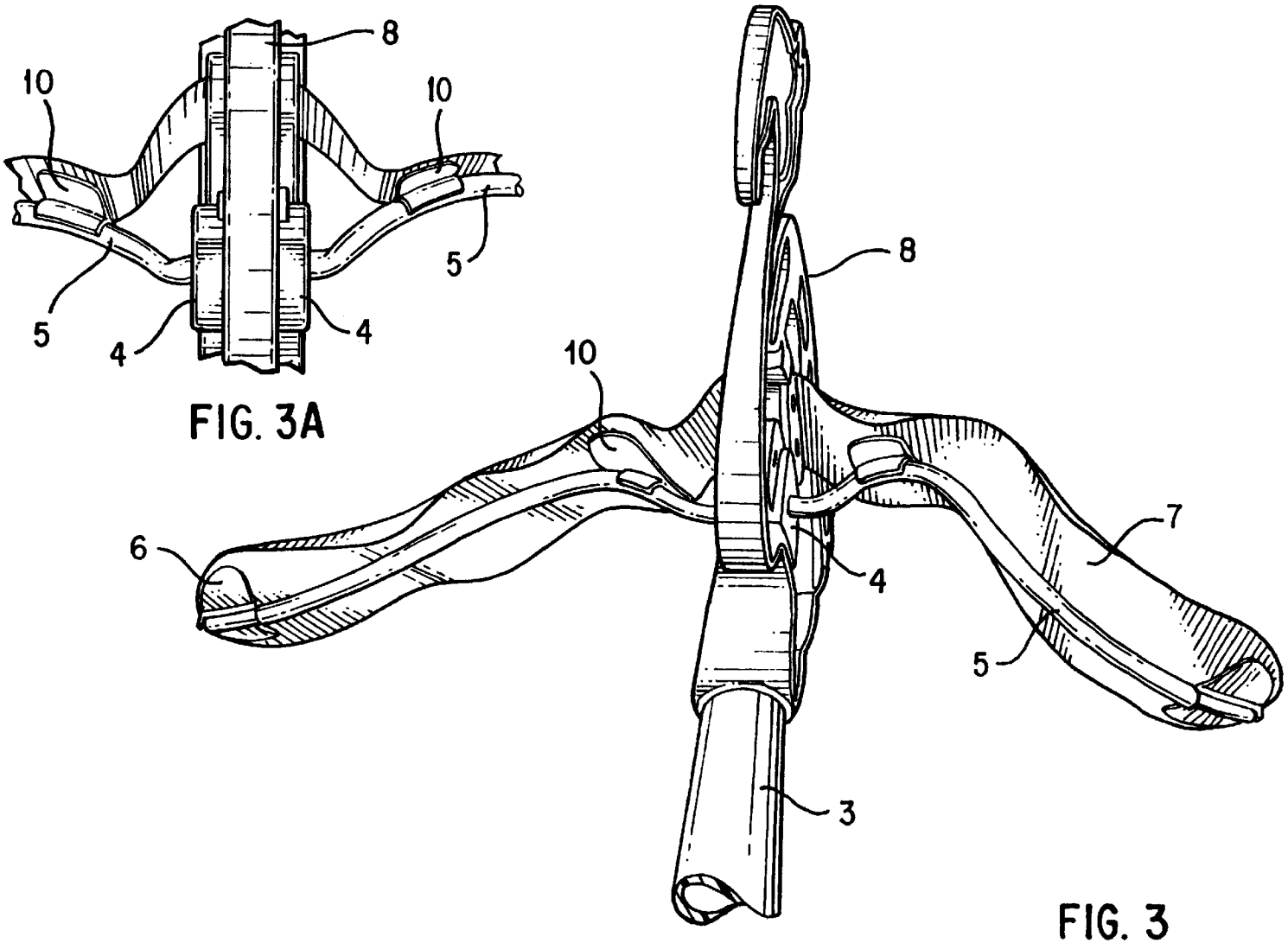
FIG. 3 is a perspective view of the sprinkler.
FIG. 3A is a detail view of a portion of the sprinkler.

As shown in FIGS. 3 and 3A, the tubes 5 are connected at their proximal ends to body 8 and reservoir 11 through T-couplings 4. Each tube 5 is affixed to the underside of a respective wing 7 at the proximal portion of the wing 7 by wing tube connectors 10. The tubes 5 extend along the underside of the wings 7 and include nozzles 6 at their distal ends. The nozzle 6 portions of the tubes 5 affix the distal ends of the tubes 5 to the distal ends of wings 7. Although the present embodiment illustrates the tubes attached along an outside surface of the wings 7, it is also envisioned that the tubes could be partially or entirely concealed from view by extending along the inside of (i.e., within) the wings 7. As seen in the exploded view of FIG. 4, tubes 5 enter T-couplings 4 through a central cylindrical portion of each T-coupling 4, which extends from each T-coupling 4 in the direction of the sprinkler body 8. The cylindrical portions of T-couplings 4 are inserted into reservoir 11. The inner diameter of the opening in reservoir 11 designed to accept the cylindrical portions of T-couplings 4 forms a press fit with the cylindrical portions such that when the T-couplings are fastened to the body 8 the connection is water tight. The T-couplings 4 are affixed to the body 8 with screws, but it is envisioned that they could be affixed by other fasteners, adhesive, be integrally formed, or joined in any number of other ways including ultrasonic welding, etc.

Figure 4:
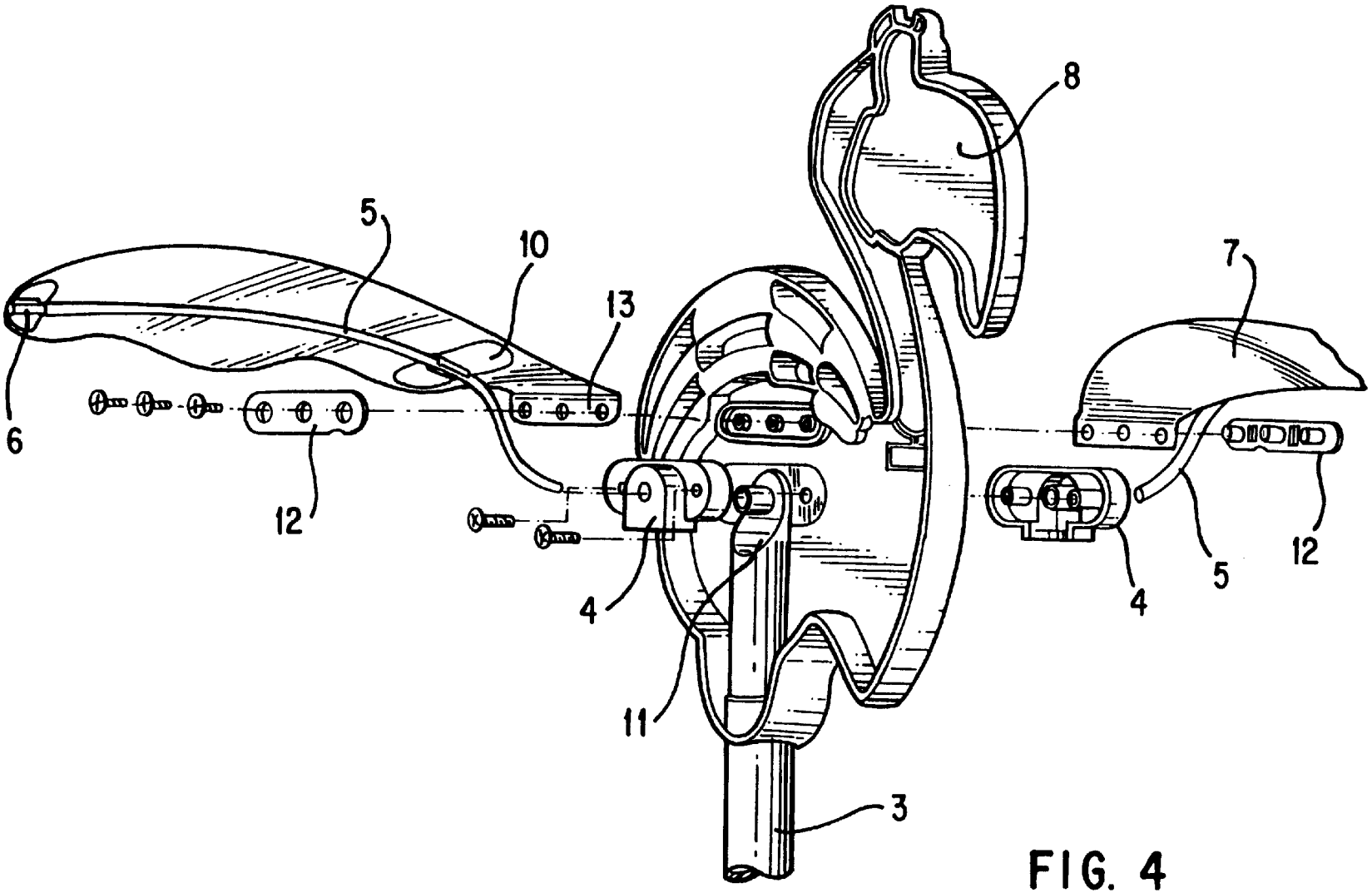
FIG. 4 is an exploded view of the sprinkler.
Figure 5:
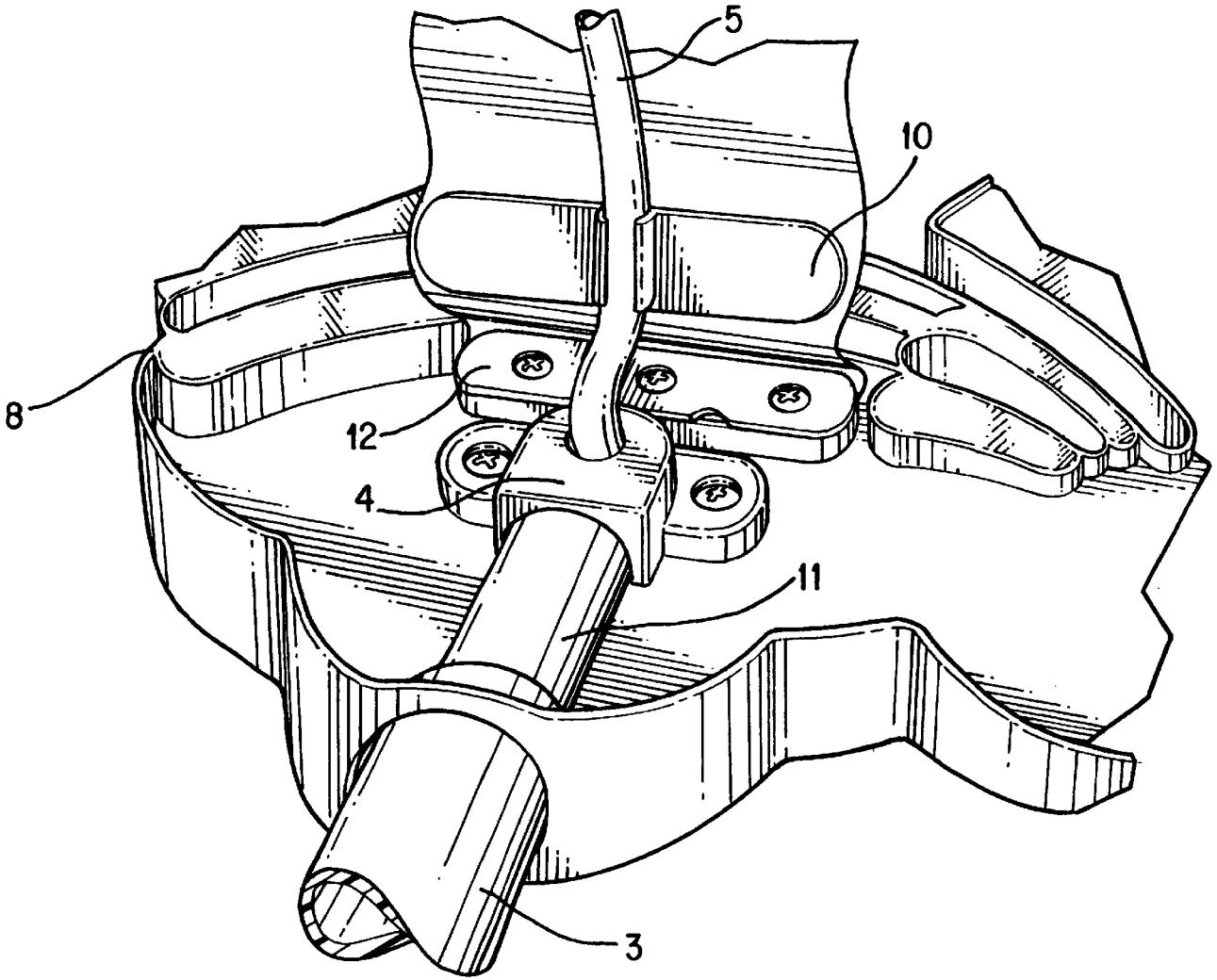
FIG. 5 is a perspective view of a portion of the sprinkler.

Each wing 7 has a proximal, or near, end, and a distal, or far, end. The wings 7 could each be characterized as having a planar-like shape, in that, although not perfectly two dimensional and flat, each wing 7 is substantially longer and wider than it is thick. The wings 7 in the present embodiment are flexible (but taut) and made of a nylon fabric, but could be made of many other materials. The proximal end of each wing 7 is sandwiched between a wing clamp plate 12 and body 8. The wing clamp plate 12 is affixed to the body 8 with screws in the present embodiment. However, any fastener, adhesive, or snap fit connection could also be employed. The wings 7 could also be integrally formed with the body 8, or could be integrally formed with one another. As seen in FIGS. 4 and 5, the wing clamp plate 12 creates a hinged connection between the wing 7 and the body 8. Each wing 7 is folded over a top edge of the wing clamp plate that forms an axis of rotation for the wing. The proximal portion of the wing is fixed relative to body 8 by the clamp plate 12 and the distal portion of the wing is free to reciprocate in an up and down motion substantially perpendicular to the edge of the wing clamp plate.

A wing tube connector 10 fixes each tube 5 adjacent the proximal end of the wing 7 and, as seen in FIG. 5, its major axis is perpendicular to the major axis of the tube 5. The portion of the connector 10 coupled to each wing 7 lies flush along the each wing 7 and is of a planar configuration. The wing tube connectors 10 can be formed integrally with the wings 7 or separately attached using conventional joining techniques. Each wing tube connector 10 can be provided to extend across substantially the entire width of the wing and with a thickness sufficient to decrease the flexibility of the wing at least in the localized area near the connector. The connectors 10 act as bracing members for the tubes 5 and resist movement of the tubes 5 and the wings 7 outside of a plane substantially perpendicular to the axis of rotation. The wider the connectors 10, the more effective the resistance to movement of the tubes 5 and wings 7 outside of the plane substantially perpendicular to the axis of rotation.

As the water flows through tubes 5 from the leg 3 and reservoir 11, and is jetted out from nozzles 6, the water applies a force to the tubes 5. The forces exerted on the tubes in turn cause the wings 7 to rotate about their axes of rotation at the top edges of the clamp plates 12 in a reciprocating motion, thus simulating a flamingo in flight. The wing tube connectors 10 are positioned on the wings 7 closer to the clamped proximal ends of the wings than to the free distal ends. This positioning of the wing tube connectors reduces the moment arm of the forces exerted on the wings through the tube connectors relative to the fixed proximal ends of the wings, and thus enhances the resistance to movement of the wings outside of a plane perpendicular to the axes of rotation. At lower pressures of water the movement of the wings is thus limited to traveling in a direction substantially perpendicular to the plane of the wing 7 and perpendicular to the axes of rotation. In a preferred embodiment of the flamingo sprinkler 9, water pressures less than 35 psi cause the wings to reciprocate in primarily a single plane perpendicular to the axes of rotation of the wings. At higher water pressures, the force the water exerts on the tubes 5 (which in turn exert forces on the wings 7 through wing tube connectors 10 and nozzles 6) can overcome the resistance the hinge and wing tube connecter 10 pose to movement of the wings 7 parallel to the axis of the hinge. Hence, rather than moving in a substantially planar manner, the wings 7 move in a random motion.

It will be apparent to those skilled in the art that various modifications and variations can be made in the play sprinkler of the present invention and in the structure of the sprinkler without departing from the scope or spirit of the invention. For instance, the water pressure at which movement of the wings departs from substantially planar movement perpendicular to the axes of rotation can vary depending on a number of factors such as the rigidity of the materials used to form the wings and the tube connectors, the positioning of the tube connectors relative to the clamped, proximal ends of the wings, the length of the wings and the restriction to flow presented by the nozzles at the ends of the water tubes. Additionally, the play sprinkler could have the form of any type of figure or creature with moving appendages.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A sprinkler comprising:

a body;

an appendage having a distal portion and a proximal portion, the proximal portion of the appendage being coupled to the body and the distal portion of the appendage being free to move relative to the body; and a conduit connected to and extending along the appendage such that when a liquid travels through the conduit the force of the liquid against the conduit moves the appendage, wherein the coupling between the appendage and the body and the connection between the conduit and the appendage maintain the movement of the appendage along a single substantially planar path when the liquid pressure is below a first amount, and the coupling between the appendage and the body and the connection between the conduit and the appendage permit the appendage to move in a substantially random direction in three-dimensional space when the liquid pressure is above the first amount.

2. The sprinkler of claim 1, further comprising a support member for connection to a ground surface so as to stabilize the body.

3. The sprinkler of claim 2, wherein the support member provides a fluid connection to the conduit.

4. The sprinkler of claim 3, wherein the support member is a post.

5. The sprinkler of claim 4, wherein the post has a foot-like member.

6. The sprinkler of claim 1, wherein the proximal portion of the appendage is hinged to the body and the distal portion is free to reciprocate about an axis of the hinged connection between the supporting member and the body.

7. The sprinkler of claim 1, wherein the conduit includes a tube and a nozzle.

8. The sprinkler of claim 6, wherein the conduit is connected to the proximal portion of the appendage.

9. The sprinkler of claim 8, wherein the appendage and conduit are flexible.

10. The sprinkler of claim 9, wherein the body is rigid.

11. The sprinkler of claim 10, having at least two appendages free to move relative to the body, both appendages having a conduit extending along some portion thereof.

12. The sprinkler of claim 11, wherein two of the appendages free to move relative to the body are shaped like wings.

13. The sprinkler of claim 1, wherein at least part of the conduit is attached to the outside of the appendage.

14. The sprinkler of claim 13, wherein the conduit is attached to the appendage by a rigid connector that extends substantially across the width of the appendage.

15. The sprinkler of claim 6, wherein the proximal portion of the appendage is integrally formed with the body.

16. A sprinkler comprising:

a body;

a planar-like flexible appendage that is hinged at a proximal portion to the body;

a conduit extending along the appendage, the conduit having a nozzle;

a rigid connector connecting the conduit to the proximal portion of the appendage;

wherein the combination of the planar-like shape of the appendage, the hinged connection and the rigid connector exert a force on the conduit that resists movement of the appendage outside of a substantially planar path when a liquid passes through the conduit.

17. The sprinkler of claim 16 further comprising a support member arising from the body which has a ground engaging member for inserting and stabilizing the sprinkler in the ground.

18. The sprinkler of claim 17 wherein the combination of the planar-like shaped appendage, the conduit, and the body are in a substantially triangular configuration such that when the liquid pressure is below a first amount, movement of the appendage outsides of substantially planar path is resisted, and when the amount, the appendage moves in a more random path in three-dimensional space.

19. The sprinkler of claim 18 wherein the body and conduit are flexible, and the support member is rigid.

20. The sprinkler of claim 19 further comprising a coupler located near the ground engaging member that is in fluid communication with the conduit and is capable of coupling to a liquid source.

21. The sprinkler of claim 20, wherein the appendage is in the shape of a wing, and the body is in the shape of a bird.

22. The sprinkler of claim 21, wherein the bird-shaped body is in the shape of a flamingo.

23. The sprinkler of claim 20, wherein the hinged connection between the proximal portion of the appendage and the body is an integral connection.

24. A sprinkler comprising:

a body;

an appendage hinged to the body allowing for a reciprocating motion relative to the body; and a flexible tube coupled to the appendage, wherein as liquid flows through the tube, the force of the liquid against the tube causes the appendage to reciprocate relative to the body and the coupling between the flexible tube and the appendage maintains the appendage along a single substantially planar path at or below a given liquid pressure and permits the appendage to move randomly in three-dimensional space above the given liquid pressure.

25. The sprinkler of claim 24 further comprising a support member, with the support member being in fluid communication with the tube.

26. The sprinkler of claim 25, wherein the tube is connected to the appendage by a connector that extends substantially across the width of the appendage.

27. The sprinkler of claim 25, wherein the appendage is in the shape of a wing and the body is in the shape of a bird.

* * * * *